US005516007A

United States Patent [19]

Larson

[11] Patent Number: 5,516,007

[45] Date of Patent: May 14, 1996

[54] DISPENSER

[76] Inventor: Donna M. Larson, 4850 Chicago Ave. S., Minneapolis, Minn. 55417

[21] Appl. No.: 354,211

[22] Filed: Dec. 12, 1994

[51] Int. Cl.[6] ..... B65D 35/28

[52] U.S. Cl. ..... 222/105

[58] Field of Search ..... 222/92, 95, 105, 222/107

[56] References Cited

U.S. PATENT DOCUMENTS

| | | | |
|---|---|---|---|
| 3,134,494 | 5/1964 | Quinn . | |
| 3,223,289 | 12/1965 | Bouet | 222/95 X |
| 3,936,334 | 2/1976 | Kushida et al. . | |
| 3,938,706 | 2/1976 | Cohen . | |
| 4,039,103 | 8/1977 | Julliet . | |
| 4,098,434 | 7/1978 | Uhlig | 222/95 X |
| 4,469,250 | 9/1984 | Evezich | 222/95 X |
| 4,760,937 | 8/1988 | Evezich . | |
| 4,821,896 | 4/1989 | Cheng . | |
| 4,842,165 | 6/1989 | Van Coney | 222/95 |
| 5,012,956 | 5/1991 | Stoody . | |
| 5,100,025 | 3/1992 | Mcgraw | 222/95 |
| 5,234,688 | 8/1993 | Gaffar | 222/105 X |
| 5,318,204 | 6/1994 | Davis et al. | 222/105 X |
| 5,332,121 | 7/1994 | Schmidt et al. . | |
| 5,385,269 | 1/1995 | Richter et al. | 222/105 |

FOREIGN PATENT DOCUMENTS

| | | | |
|---|---|---|---|
| 548840A2 | 6/1993 | European Pat. Off. | 222/105 |
| 3-133748 | 6/1991 | Japan | 222/95 |
| 92/11187 | 7/1992 | WIPO | 222/105 |

*Primary Examiner*—Andres Kashnikow
*Assistant Examiner*—Kenneth Bomberg
*Attorney, Agent, or Firm*—Burd, Bartz & Gutenkauf

[57] ABSTRACT

A dispenser for a flowable material has a housing with a chamber accommodating a flexible bag containing the flowable material. The bag has a neck retain on the housing with a cap or nipple mounted on the dispensing end of the housing. The housing has an open bottom end closed with a door. In one embodiment, the door is hinged to the housing. A releasable latch connected to the housing and door retains the door in the closed position. In another embodiment, the door is releasably retained a bead joined to the lower section of the housing.

18 Claims, 4 Drawing Sheets

DISPENSER

FIELD OF THE INVENTION

This invention relates to dispensing devices for flowable materials located within a flexible bag. More particularly, the dispenser has a flexible casing having one open end closed with a door and a second open end accommodating a cap or a nipple closed with a cap. The cap or nipple secures a portion of the bag to the casing.

BACKGROUND OF THE INVENTION

Flowable materials or products such as ketchup, mustard, honey, salad dressings, sauces, condiments, oils and liquid detergents are stored in flexible plastic bottles having an open upper end accommodating a cap. The cap can be opened or removed from the bottle to allow the contents of the bottle to be poured to a desired location or into another bottle. Bottles that accommodate semi-solid materials do not readily allow all of the materials to be removed from the inside thereof. Squeezable dispensing devices having deformable inner containers accommodating the material to be dispensed located within resilient outer containers have been developed. Evezich discloses in U.S. Pat. No. 4,760,937 a squeezable container accommodating an inner flexible bag containing the material to be dispensed. The material to be dispensed is directed through a dispensing nozzle mounted with a threaded ring on the outer container. The nozzle is permanently attached to the inner container. A dispenser having a flexible bag for ejecting fluid is disclosed by Cohen in U.S. Pat. No. 3,938,706. The flexible bag is located within a container. The bottom of the container has a push plate which is urged into pressure engagement with the bag, thereby causing material to be dispensed from the bag when an on/off valve mounted on the container is in the open position. Plastic liners in the shape of a bag have been used with nursing bottles to accommodate the fluid foods.

SUMMARY OF THE INVENTION

The invention relates to a dispenser for a flowable material or product having a collapsible bag storing the material. The bag being a package for the material is inserted into the dispenser and removed from the dispenser when empty. The dispenser is reused with a new bag thereby reducing environmental waste. The flowable materials can be food products, such as ketchup, jelly, vegetable oil, salad dressings, honey, orange juice, sauces and like liquid-type products, or other products, such as liquid soaps, detergents and cleaning fluids. These flowable materials are examples of the products useable with the dispenser. Other types of flowable materials can be used with the dispenser and the bag associated with the dispenser.

The dispenser has a housing having a chamber for accommodating a flexible bag storing the material. The housing has a body with an open bottom end and a convex-shaped neck joined to the body. The neck is joined to a head having an opening. A door is releasably connected to the body to close the open bottom end of the body. In one embodiment of the dispenser, a latch retains the door in a position to close the open bottom end of the body to confine the bag within the housing. The bag has an end folded over the head and retained on the head with a cap or nipple accommodating a cap. The cap or nipple can be released from the head to allow the bag to be removed from the dispenser when the door is in the open position. A refill bag is inserted into the housing and through the neck and head. The end of the bag extended out of the had is cut to open the bag. This end is then folded over the head. The cap or nipple is mounted on the head to seal and secure the folded portion of the bag to the head.

One embodiment of the dispenser has a housing including a generally rectangular body having side walls and end walls and an inverted cone-shaped neck with a concave wall joined to the body, and a tubular head joined to the neck. The body has an open end opposite the neck. The head has an open end. A door movable to a first position to close the open end of the body and to a second position to open the open end of the body has generally flat bottom walls and upright walls. A live hinge connects an upright wall of the door to one end wall of the body. A releasable latch connects the door to another end wall of the body for holding the door in the first position. The latch being releasable allows the door to be moved from the first position to the second position to open the open end of the body. A bag having a body and a convex neck joined to the body accommodates flowable material. The neck of the body has an open end extended around the head. A cap mounted on the head holds the neck on said head. The cap has an opening to allow flowable material to move from the bag to a selected location. A lid mounted on the cap selectively opens and closes the opening in the cap.

Another embodiment of the dispenser has a housing comprising a body and a neck joined to the body surrounding an internal chamber for accommodating a flexible bag for storing a flowable product. The body has an open bottom and a lower end having an outwardly-directed bead. The neck has a convex cone shape. When inverted, the body and neck have a funnel shape. The bag is inserted into the chamber through the open bottom of the housing. The neck has an open upper end. A nipple attached to the upper end of the neck secures the bag to the neck of the housing. The remainder of the bag is free to collapse in the chamber. A cap mounted on the nipple closes the nipple. The cap can be removed from the nipple to allow the product to flow out of the bag. A door having a bottom wall closes the open bottom of the body. The door has a lip that cooperates with the bead to releasably hold the door on the body. The body has an air hole to allow air to flow into and out of the internal chamber. A person can close the air hole and squeeze the body to increase the air pressure in the chamber to force the flowable product out of the bag.

DESCRIPTION OF THE PREFERRED EMBODIMENTS

Figure 1:
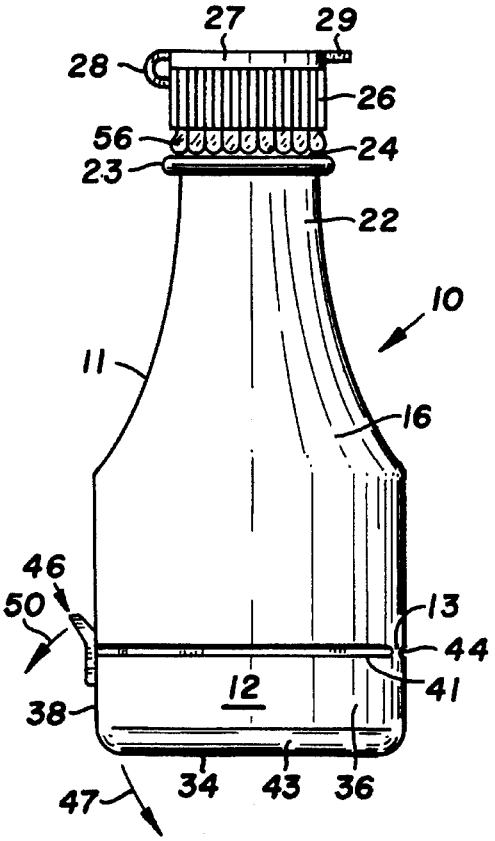
FIG. 1 is a front elevational view of the dispenser of the invention.
Figure 2:
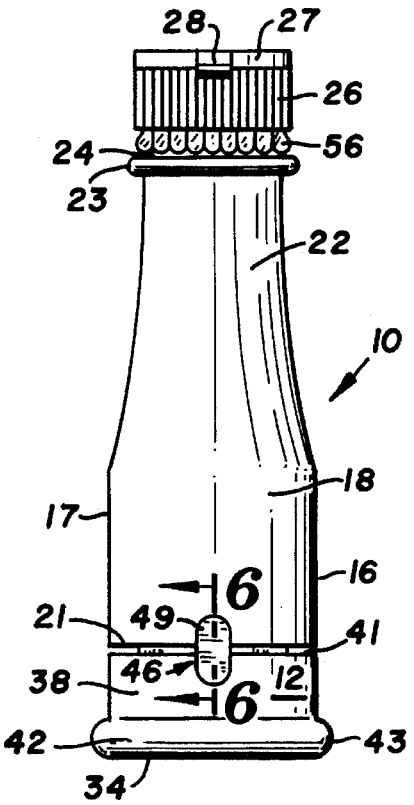
FIG. 2 is a left side elevational view thereof.
Figure 3:
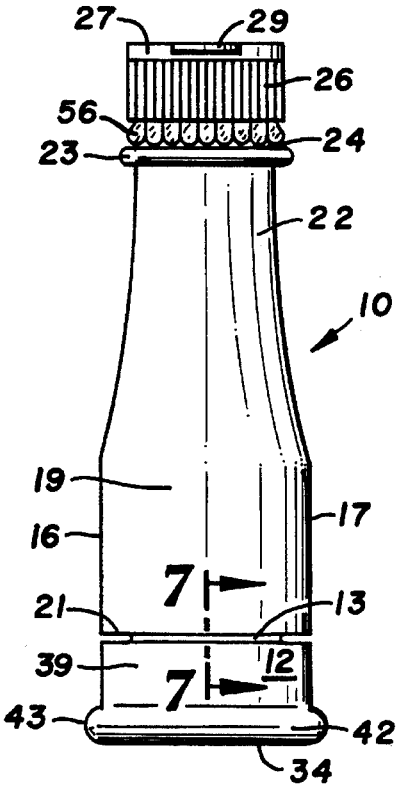
FIG. 3 is a right side elevational view thereof.
Figure 4:
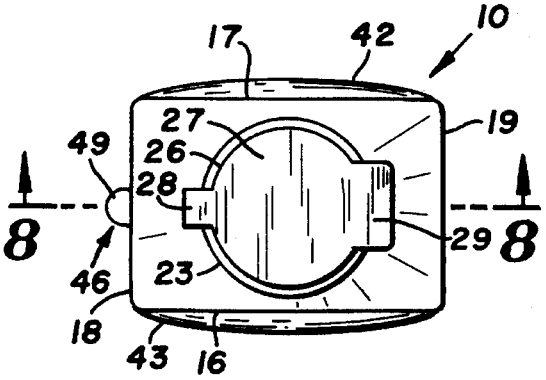
FIG. 4 is a top plan view thereof.

Referring to FIGS. 1–5, there is shown a dispenser, indicated generally at 10, for use in manually dispensing flowable products and materials such as food products, including, but not limited to, ketchup, mustard, mayonnaise, condiments, oils, milk, honey, syrup and the like. The flowable materials can be liquid soaps, wax and cleaners. Dispenser 10 has a casing or housing, indicated generally at 11, and a door 12 located below housing 11. Door 12 is movably connected to housing 11 with a hinge 13. Housing 11 has a generally rectangular body 14. The body 14 has upright side walls 16 and 17 joined to end walls 18 and 19. The walls 16–19 have a continuous bottom edge 21 extending from opposite sides of hinge 13. Hinge 13 is a live hinge which integrally joins body 14 to door 12. An upwardly directed inverted cone-shaped neck 22 is joined to the top of body 14. The upper end of neck 22 has an outwardly-directed annular collar 23. Collar 23 serves as a hand stop which minimizes the slipping of the hand off neck 22. Neck 22 has a convex shape with an arcuate configuration having a radius that is greater than the horizontal length of the side wall 16. The curvature of neck 22 generally conforms with the palm of a person's hand when the thumb and first finger are located about neck 22 adjacent collar 23. This enables the hand to firmly grip the neck to minimize inadvertent dropping and throwing of the dispenser.

Figure 9:
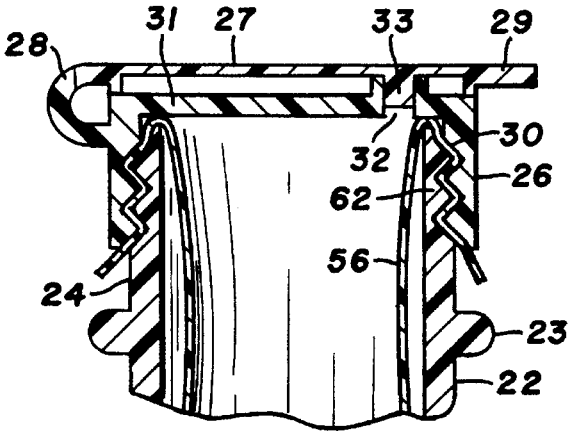
FIG. 9 is an enlarged sectional view of the top of the dispenser, as shown in FIG. 8.

An upwardly-directed generally tubular head 24 is joined to the top of collar 23. As seen in FIG. 9, head 24 has outwardly-directed ribs or threads 62 accommodating a cap 26. Cap 26 has internal threads and grooves 30 accommodating threads 62 whereby cap 26 can be firmly attached to head 24. Body 14, neck 22 and head 24 are a one-piece plastic member. The plastic can be polyethylene or similar type of plastic material. Body 14, neck 22 and head 24 form an internal chamber 25, which when inverted, has a general funnel shape.

As shown in FIG. 9, cap 26 is covered with a lid 27. A hinge loop 28 movably connects lid 27 to a side portion of cap 26. Lid 27 has a outwardly-directed lip 29 opposite hinge loop 28. Lip 29 serves as a finger grip or projection that allows the user to pry open the lid. Cap 26 has a horizontal top wall 31 joined to a downwardly-directed cylindrical side wall that accommodates threads 30. Top wall 31 has an upwardly-directed tubular spout 32 providing a discharge hole that extends through top wall 31. Lid 27 has a downwardly-directed cylindrical projection 33 that fits into the hole of spout 32 to close the hole and frictionally retain lid 27 in the closed position.

Figure 5:
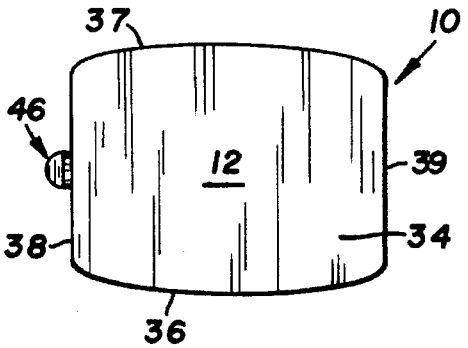
FIG. 5 is a bottom plan view thereof.
Figure 6:
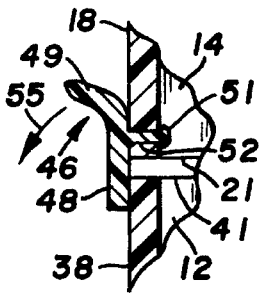
FIG. 6 is an enlarged sectional view taken along the line 6—6 of FIG. 2.

Returning to FIGS. 1–5, door 12 has a generally flat bottom wall 34 joined to upright side walls 36 and 37, and end walls 38 and 39. Bottom wall 34 is a generally rectangular cup-shaped structure having a continuous top edge 41. As seen in FIG. 6, top edge 41 is located in vertical alignment with bottom edge 22 of body 14 when door 12 is closed. Opposite side portions of door 12 have outwardly-directed ribs 42 and 43 which increase the surface area of bottom wall 34. This provides dispenser 10 with additional lateral support thereby minimizing the inadvertent tipping of the dispenser when it rests on a horizontal surface.

Figure 7:
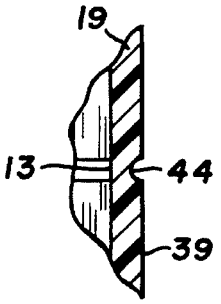
FIG. 7 is an enlarged sectional view taken along the line 7—7 of FIG. 3.

As seen in FIG. 7, hinge 13 is a live hinge that joins end wall 19 of body 14 to side wall 39 of door 12. Hinge 13 includes a horizontal score or groove 44 which facilitates the flexing of hinge 13.

Door 12 is retained in the closed position adjacent the bottom of body 14 with a releasable latch 46. When latch 46 is released, door 12 can be swung downwardly to an open position as indicated by arrow 47 in FIG. 1. This opens the bottom of body 14 to allow a flexible bag or container 53 to be located within chamber 25. Latch 46 has a flexible generally flat member 48 attached to end wall 38 with a weld or suitable adhesive materials. The upper end of member 48 has an outwardly-directed tab 49 which serves as a finger grip to allow the user to flex the latch 46 to an open position in the direction of arrow 50, as seen in FIGS. 1 and 6. Member 48 has an inwardly-directed projection or finger 51 that extends through a hole 52. The inner end of the projection 51 is enlarged whereby projection 51 has a snap fit through hole 52 to hold latch 46 in the closed position. When latch 46 is in the closed position, adjacent edges 21 of body 14 of door 12 engage each other thereby stabilizing body 14 on door 12.

Figure 10:
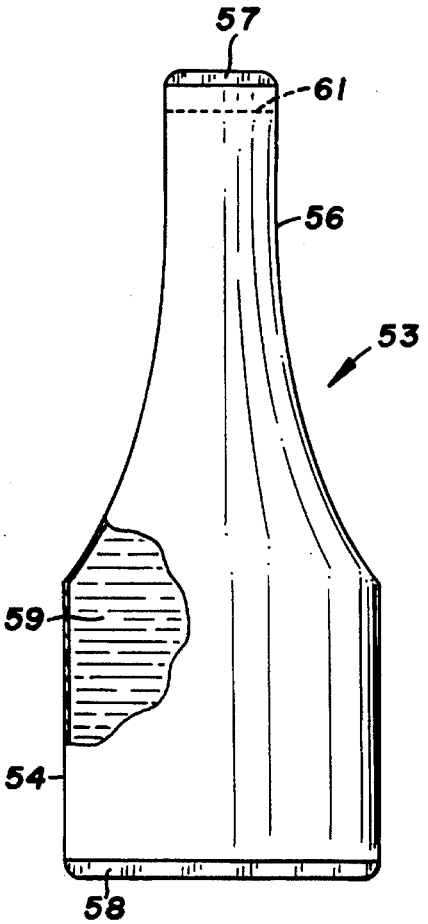
FIG. 10 is a front elevational view, partly sectioned, of the replaceable bag for accommodating the flowable materials used with the dispenser.
Figure 11:
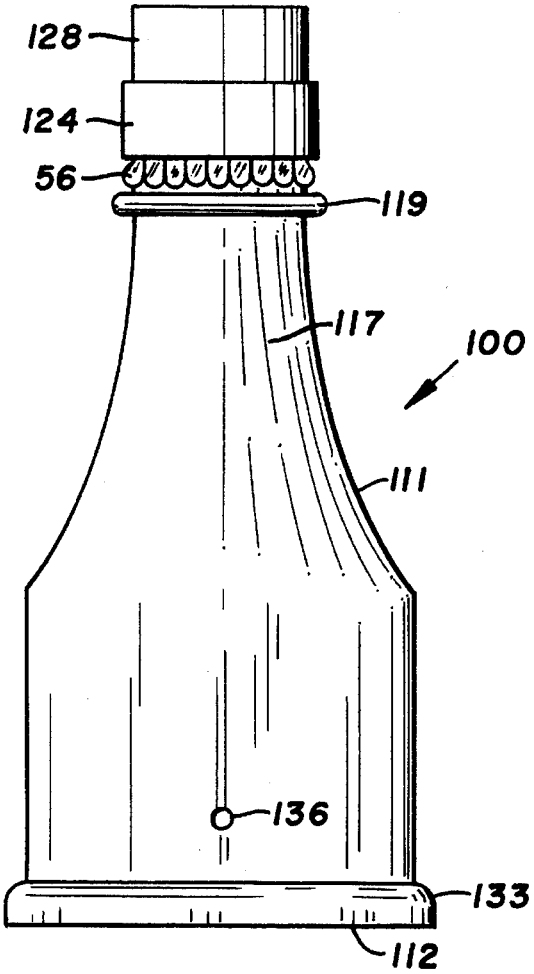
FIG. 11 is a front elevational view of a modification of the dispenser of the invention.
Figure 12:
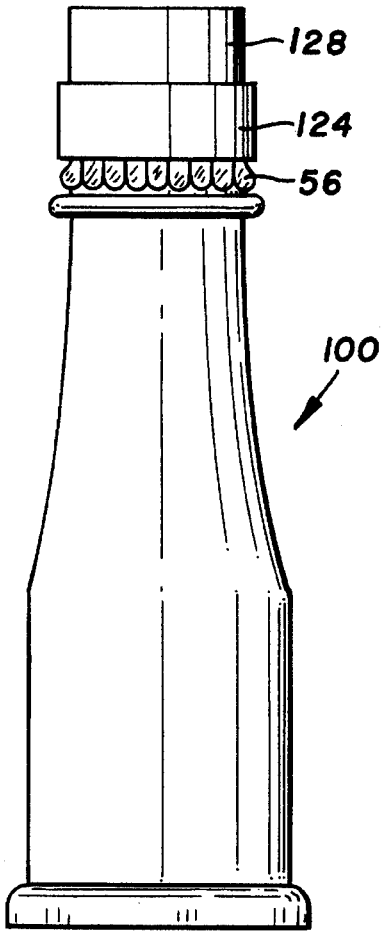
FIG. 12 is a side elevational view of the dispenser of FIG. 11.
Figure 13:
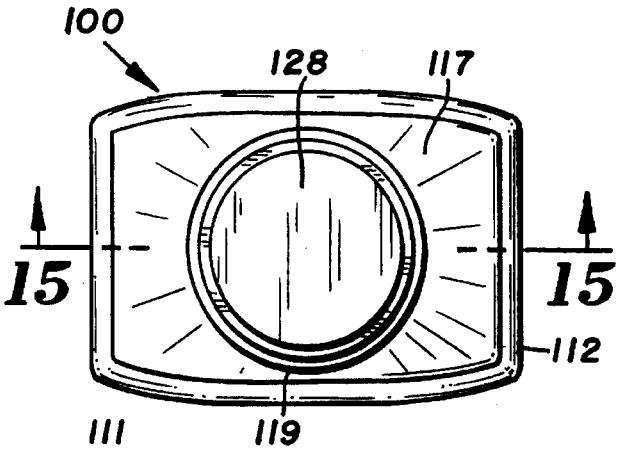
FIG. 13 is a top plan view of the dispenser of FIG. 11.
Figure 14:
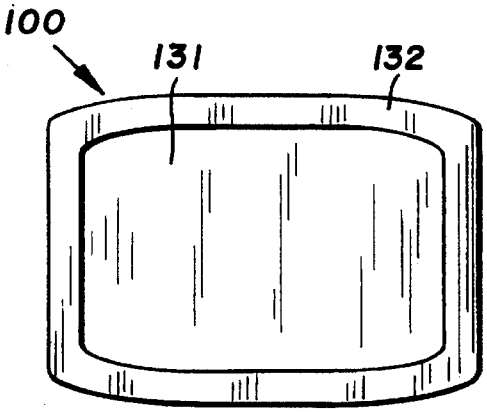
FIG. 14 is a bottom plan view of the dispenser of FIG. 11.

Referring to FIG. 10, there is shown a bag or container 53 for accommodating the flowable material 59. Bag 53 has a body 54 and an upwardly-inverted conical-shaped neck 56 terminating in a closed end 57. The bottom of body 54 is closed with a seam 58 after the flowable material has been placed within the bag. The entire bag 53 can be made of flexible plastic material such as a plastic film. Bag 53 can be packaged in a suitable container such as cardboard or paper boxes for convenient display on the retail market.

Figure 8:
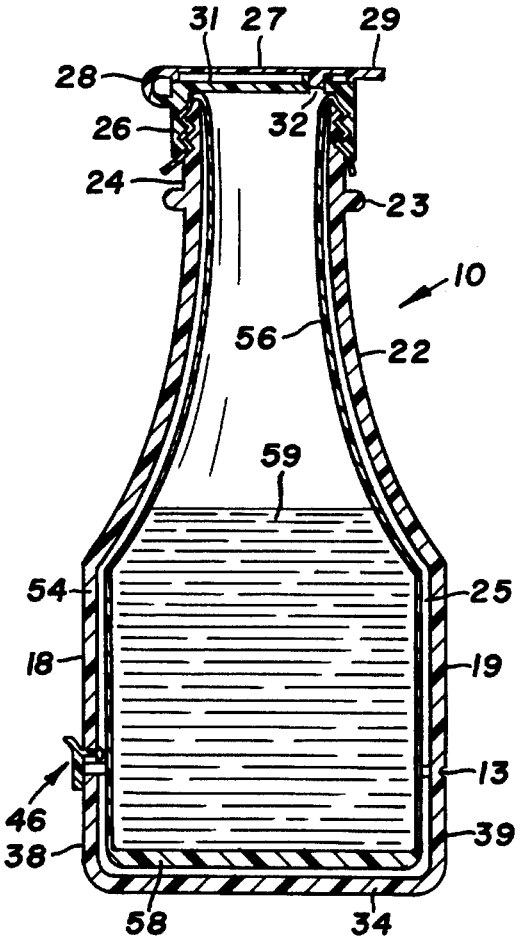
FIG. 8 is an enlarged sectional view taken along the line 8—8 of FIG. 3.

In use, bag 53 is placed within internal chamber 25 by opening door 12. Latch 46 is released to allow door 12 to swing to the open position. Cap 26 is removed from the head of the housing. This opens the upper end of head 24. Bag 53 is then placed within the housing with the upper end of neck 26 projecting outwardly out of the open end of head 24. Door 12 is then returned to the closed position and latch 46 connected to the side wall 18, as shown in FIG. 6. The upper end of neck 56 projects outwardly from the top of head 24. Neck 56 is opened by cutting along cut line 61. The upper portion of neck 56 is then folded or turned over the top of head 24. Cap 26 is then threaded onto head 24 with the upper portion of the neck sandwiched and sealed between head 24 and cap 26, as seen in FIGS. 8 and 9. The flowable material can then be dispensed from bag 53 by opening lid 27. The material can flow through neck 56 of bag 53 and the opening through spout 32 to a desired location. Bag 53 collapses as the material flows out of the bag.

When bag 53 is empty, cap 26 is removed from head 24, thereby releasing neck 56 of bag 53. Latch 46 is moved to the open position. Door 12 is then swung downwardly as indicated by the direction of the arrow 47. Bag 53 can then be withdrawn from the housing 11 and replaced with a new bag.

Referring to FIGS. 11–15, there is shown a modification of the dispenser, indicated generally at 10, for use in manually dispensing flowable products and materials such as food products, including, but not limited to, ketchup, mustard, mayonnaise, liquid condiments, oils, milk, honey, syrup and the like. The flowable materials can be liquid soaps, wax and cleaners. Dispenser 100 has a casing or housing, indicated generally at 111, and a door 112 located below housing 111. Door 112 is releasably connected to housing 111, as show in FIG. 15. Housing 111 has a generally rectangular body 113 comprising a flexible wall 114 surrounding an internal chamber 118 and a continuous bottom edge 21. Wall 114 has a small hole 136 adjacent the bottom edge thereof to allow air to flow into and out of chamber 118. A continuous outwardly-extended bead 116 is located on the bottom edge of wall 114. An upwardly directed inverted cone-shaped neck 117 is joined to the top of body 113. The upper end of neck 117 has an outwardly-directed annular collar 119. Collar 119 serves as a hand stop which minimizes the slipping of the hand off neck 117. Neck 117 has a convex shape with an arcuate configuration having a radius that is greater than the horizontal length of the wall 114. The curvature of neck 117 generally conforms with the palm of a person's hand when the thumb and first finger are located about neck 117 adjacent collar 119. This enables the hand to firmly grip the neck to minimize inadvertent dropping and throwing of the dispenser.

Figure 15:
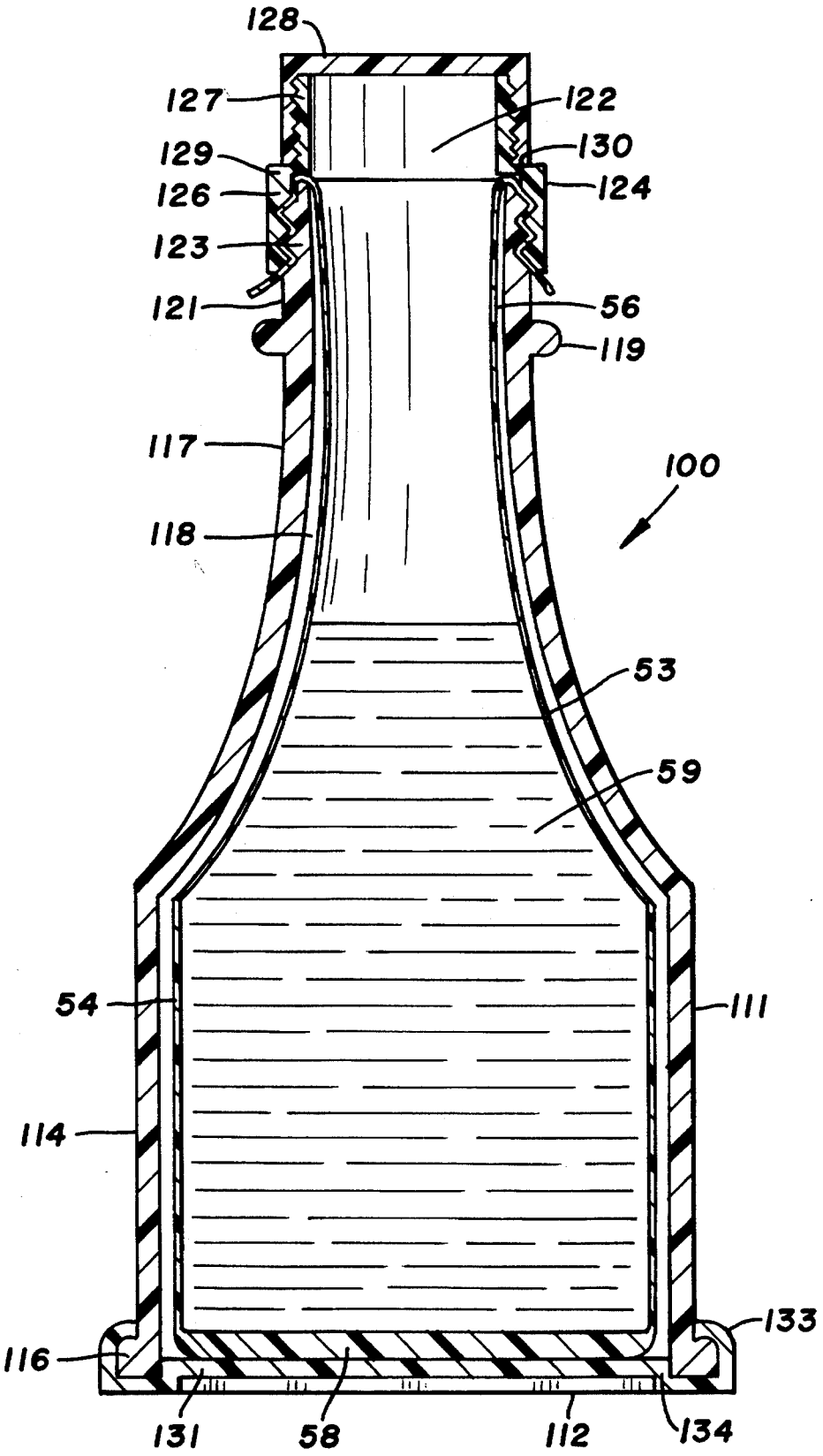
FIG. 15 is an enlarged fragmentary sectional view taken along the line 15—15 of FIG. 13.

An upwardly-directed generally tubular head 121 is joined to the top of collar 119. As seen in FIG. 15, head 121 has an open end 122 and outwardly-directed ribs or threads 123 accommodating a tubular nipple 124. Nipple 124 has a first annular portion 126 with internal threads cooperating with threads 123 to releasably attach nipple 124 to head 121 and a second annular portion 127 having extended threads. An inwardly-extended annular shoulder 129 joins first and second portions 126 and 127. Shoulder 129 is aligned with and has the annular shape of the upper end of head 121 whereby shoulder 129 is an annular stop for nipple 124. Shoulder 129 also seals nipple 124 on head 121. A cup-shaped cap 128, having internal threads, is mounted on the second portion 127 of nipple 124. Cap 128 can be removed from nipple 124 to open the passage of nipple 124. Cap 128 has a bottom annular edge 130 that is spaced from the top of shoulder 129 so that the upper end of nipple 129 bears against the top of nipple 124 to seal cap 128 thereon. The threads 123 can be left hand threads and the threads on second portion 127 can be right hand threads so that nipple 124 is not turned off head 121 when cap 128 is removed from nipple 124. Body 113, neck 117, bead 116 and head 121 are a one-piece plastic member. The plastic can be flexible polyethylene or similar type of plastic material. Body 113, neck 117 and head 121 form an internal chamber 118, which when inverted, has a general funnel shape.

Door 112 is a base cover for the bottom of body 113. Door 112 has a generally flat bottom wall 131 joined to an upright side wall 133. Bottom wall 131 is a generally rectangular structure having a continuous internal edge 134. As seen in FIG. 5, edge 134 is located in engagement with the inside of the bottom edge of body 113 when door 112 is closed. A continuous annular rib 132 surrounds bottom wall 131. Rib 132 provides dispenser 100 with lateral support thereby minimizing the inadvertent tipping of the dispenser when it rests on a horizontal surface.

An upwardly-directed annular lip 133 joined to rib 132 extends over bead 116. Lip 133 is flexible to allow it to snap over bead 116 to close the bottom of body 113. Lip 133 cooperates with internal edge 134 to hold door 112 on the lower edge of wall 114 and bead 116. Door 112 can be removed from bead 116 by pulling lip 133 off bead 116.

In use, bag 53, shown in FIG. 10, is placed within internal chamber 118 by opening door 112. Door 112 is released from bead 116 to allow door 112 to be removed from body 114 thereby opening the bottom of body 113. Nipple 124 and cap 128 are removed from head 121. This opens the upper end of head 121. Bag 53 is then placed within the housing 111 with the upper end of neck 26 projecting outwardly out of the open end of head 121. Door 112 is then returned to the closed position by forcing lip 133 onto bead 116, as shown in FIG. 15. The upper end of neck 56 projects outwardly from the top of head 121. Neck 56 is opened by cutting along cut line 61. The upper portion of neck 56 is then folded or turned over the top of head 121. Nipple 124 is then threaded onto head 121 with the upper portion of the neck sandwiched and sealed between head 121 and nozzle 124, as seen in FIG. 15. The flowable material 59 can then be dispensed from bag 53 by removing cap 128 from nipple 124. The material 59 can flow through neck 56 of bag 53 and the passage through nipple 124 to a desired location. Bag 53 collapses as the material flows out of the bag. Hole 136 in wall 114 permits air to flow into chamber 118 to allow bag 53 to collapse as the material flows out of the bag. The user can place a finger over the hole 136 and squeeze or exert pressure to opposite sides of wall 114 to increase the pressure of the air in chamber 118 to force material out of bag 53.

When bag 53 is empty, nipple 124 is removed from head 121, thereby releasing neck 56 of bag 53. Door 112 is then removed from bead 116 to open the bottom of body 114. Bag 53 can then be withdrawn from the housing 111 and replaced with a new bag.

While there has been shown and described embodiments of the dispenser and bag for accommodating flowing material to be dispensed by the dispenser, it is understood that changes in the materials, shape or arrangement of structures can be made by those skilled in the art without departing from the invention. The invention is defined in the following claims.

I claim:

1. A dispenser for flowable materials comprising: a housing having a body and a neck joined to the body, said body having an open end, a head joined to the neck, said head having a material discharge opening, said body, neck and head surrounding a chamber, cap means mounted on the head to close the material discharge opening, said cap means having lid means and a cap opening to selectively allow flowable material to dispense through said cap opening, door means for closing the open end of the body, hinge means connecting the door means to the body operable to allow the door means to be moved from a closed position to open said open end of the body, latch means cooperating with the door means and body for holding the door means in the closed position, said latch means being releasable to allow the door means to be moved from the closed position to the open position, and bag means located with said chamber storing flowable material, said bag means having a material discharge end held on the head with the cap means.

2. The dispenser of claim 1 including: a collar connecting the neck to said head, said collar projecting outwardly from said neck.

3. The dispenser of claim 2 wherein: said neck has convex wall means having a large end joined to the body and a small end joined to the head.

4. The dispenser of claim 3 wherein: the bag means has a body and a convex curved neck joined to the body and located within the neck of the housing.

5. The dispenser of claim 1 wherein: the body has side walls and end walls and a generally rectangular cross sectional shape, said neck has convex wall means having a large end joined to the body and a small end joined to the head, said convex wall means having a radius of curvature larger than the longitudinal length of the side wall.

6. The dispenser of claim 5 wherein: the bag means has a generally rectangular body and a convex curved neck joined to the body said bag means located within said chamber of the body and neck of the housing.

7. The dispenser of claim 1 wherein: the hinge means is a live hinge integral with said body and door means.

8. The dispenser of claim 1 wherein: said latch means comprises a flexible member attached to one of said body or door means, and projection means on the member extend through a hole in the other of said body or door means to retain the door means in the closed position.

9. The dispenser of claim 1 wherein: said door means has a generally flat bottom wall and upwardly extended walls joined to the bottom wall, said hinge means being joined to a first portion of said upwardly extended walls and the body, said latch means connecting a second portion of said upwardly extended walls with said body.

10. A dispenser for a flowable material comprising: a housing including a generally rectangular body having side walls, end walls and an inverted cone-shaped neck with a concave wall joined to the body, and a tubular head joined to the neck, said body having an open end opposite the neck, said head having an open end, a door movable to a first position to close the open end of the body and to a second position to open the open end of the body, said door having a generally flat bottom wall and upright walls, hinge means connecting an upright wall of the door to one end wall of the body, latch means connecting the door to another end wall of the body for holding the door in the first position, said latch means being releasable to allow the door to be moved from the first position to the second position to open the open end of the body, bag means having a body and a convex neck joined to the body for accommodating flowable material, said bag means neck having an open end extended around the head, and cap means mounted on the head holding the bag means neck on said head, said cap means having an opening to allow flowable material to move from the bag means to a selected location, and means to selectively open and close the opening in the cap means.

11. The dispenser of claim 10 wherein: said head includes external thread-like members, said cap means having internal thread-like members, said neck of the bag means having an end folded over said external thread-like members of said head and retained thereon by the external thread-like members of the cap means.

12. The dispenser of claim 10 wherein: the hinge means is a live hinge integral with the one end wall of the body and the upright wall of the door.

13. The dispenser of claim 10 wherein: said latch means comprises a flexible member attached to one of the other end walls of the body or the upright wall of the door, and means releasably connecting the latch means to one of the other end walls of the body or the upright wall of the door to retain the door in the closed position.

14. The dispenser of claim 10 wherein: said latch means comprises a flexible member attached to the upright wall of the door and extended adjacent one end wall of the body, said one end wall of the body having a hole aligned with the flexible member, and a projection secured to the flexible member extendable in the hole to retain the door in its first position, said member being movable away from the body to move the projection out of the hole thereby allowing the door to be moved to the second position.

15. A dispenser for a flowable material comprising: a housing having a chamber and a first end having a first opening to the chamber and a second end having a second opening to the chamber, door means mounted on the housing movable to a first position to close the first opening and to a second position to open said first opening, means for holding the door means in said first position, hinge means connecting the door means to the housing, said means for holding the door means in the first position including latch means releasably connecting the door means to the housing, a bag for storing a flowable material located within said chamber, said bag having an end with an opening to allow the material to flow from said bag, said end of the bag extended around the second end of the housing, and means holding the end of the bag on the second end of the housing.

16. The dispenser of claim 15 wherein: the housing has an upwardly converging neck, said neck having said second end and opening of the housing, said bag having a converging neck located within the converging neck of the housing.

17. The dispenser of claim 16 including: a tubular head joined to the neck of said housing, said head includes external thread-like members, said means holding the bag on the second end of the housing includes internal thread-like members, said neck of the bag having an end folded over said external thread-like members and retained thereon by the internal thread-like members of said holding means.

18. The dispenser of claim 15 wherein: the means holding the end of the bag on the second end of the housing includes a tubular nipple releasably mounted on the second end of the housing, said nipple holding the end of the bag on the second end of the housing, and cap means removably mounted on the nipple to close said nipple.

* * * * *